US006330424B1

(12) United States Patent
Chapman et al.

(10) Patent No.: US 6,330,424 B1
(45) Date of Patent: Dec. 11, 2001

(54) METHOD AND APPARATUS FOR MINIMIZING THE OPEN LOOP PAPER POSITIONAL ERROR IN A CONTROL SYSTEM FOR AN ELECTROPHOTOGRAPHIC PRINTING APPARATUS

(75) Inventors: Danny Keith Chapman, Nicholasville; Matthew Lowell McKay; Steven Michael Turney, both of Lexington, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/717,716

(22) Filed: Nov. 21, 2000

(51) Int. Cl.[7] ..... G03G 15/00; G03G 15/14
(52) U.S. Cl. ..... 399/394
(58) Field of Search ..... 399/297, 394

(56) References Cited

U.S. PATENT DOCUMENTS

| | | | | |
|---|---|---|---|---|
| 4,310,236 | | 1/1982 | Connin | 271/277 X |
| 4,519,700 | | 5/1985 | Barker et al. | 271/226 |
| 5,455,668 | * | 10/1995 | DeBock et al. | 399/394 X |
| 5,642,297 | | 6/1997 | Brady et al. | 364/559 |
| 5,715,514 | | 2/1998 | Williams et al. | 399/395 |
| 5,794,176 | | 8/1998 | Milillo | 399/395 |
| 5,887,996 | | 3/1999 | Castelli et al. | 400/579 |
| 5,983,066 | | 11/1999 | Abe et al. | 399/394 |
| 5,995,802 | * | 11/1999 | Mori et al. | 399/394 |
| 6,014,542 | * | 1/2000 | Hozumi et al. | 399/394 |

* cited by examiner

*Primary Examiner*—Fred L Braun
(74) *Attorney, Agent, or Firm*—John V. Pezdek; Michael T. Sanderson; Ronald K. Aust

(57) ABSTRACT

A method of minimizing error in an estimate of a position of a sheet of print medium in an electrophotographic machine includes providing a transport system including a gearing system to drive a roll for moving the sheet of print medium along a print medium path. The gears are in constant mesh with each other and with an actuator. The electrophotographic machine is provided with a toner transfer point at which the toner can be transferred to the moving sheet of print medium. A sensor is placed at a set distance away from the transfer nip along the print medium path. This distance is approximately equal to an integer multiple of the resulting distance traveled by the medium during one revolution of the lowest frequency component of the transport system. The frequencies associated with all other components in the transport system, including the actuator and an encoder wheel, are designed to be an integer multiple of this lowest frequency. The gearing system is actuated with a rotating actuator such that the actuator rotates approximately an integer number of times during a corresponding rotation of the lowest frequency component. An encoder wheel is also used to provide feedback to a control algorithm. A position of the sheet of print medium is sensed with the sensor.

21 Claims, 5 Drawing Sheets

METHOD AND APPARATUS FOR MINIMIZING THE OPEN LOOP PAPER POSITIONAL ERROR IN A CONTROL SYSTEM FOR AN ELECTROPHOTOGRAPHIC PRINTING APPARATUS

BACKGROUND OF THE INVENTION

1. Field of the Invention

The present invention relates to a method and apparatus for determining the position of paper within an electrophotographic machine, and, more particularly, minimizing the error in a paper position calculation within an electrophotographic machine.

2. Description of the Related Art

It is known to use an electronic sensor to sense a sheet of paper arriving at a predetermined point along a paper path in an electrophotographic machine. After the paper has proceeded past the sensor, the position of the paper can only be estimated based upon the speed of the paper and the length of time since the paper was sensed by the sensor. Because of the difficulty of accurately estimating the fluctuating speed of the paper, problems exist as to determining the location of the paper in a paper path relative to a transfer nip.

What is needed in the art is a method of accurately determining the location of paper in a paper path relative to a transfer nip.

SUMMARY OF THE INVENTION

The present invention provides gear mesh and encoder frequencies and sensor placement relative to a transfer nip that enable very accurate transportation of the media at the proper time to the transfer nip.

The invention comprises, in one form thereof, a method of minimizing error in an estimate of a position of a sheet of print medium in an electrophotographic machine. A transport system that includes an actuator and a gearing system is provided to drive a set of rollers for moving the sheet of print medium along a print medium path. The gears are in constant mesh with each other and with the actuator. An encoder wheel is also provided to give feedback to a motion control algorithm. The electrophotographic machine is provided with a toner transfer point at which the toner can be transferred to the moving sheet of print medium. A sensor is placed at a set distance away from the transfer nip along the print medium path. This distance is approximately equal to an integer multiple of the resulting distance traveled by the medium during one revolution of the lowest frequency component of the transport system. The frequencies associated with all other components in the transport system, including the actuator and encoder wheel, are designed to be an integer multiple of this lowest frequency. A position of the sheet of print medium is sensed with the sensor.

The invention comprises, in another form thereof, an electrophotographic machine including an actuator that drives a set of rollers through a transport system that includes a gearing system. The actuator is provided for moving a sheet of print medium along a print medium path. The gears are in constant mesh with each other and with the actuator. An encoder wheel is also provided to give feedback to a motion control algorithm. A toner transfer mechanism transfers toner to the moving sheet of print medium. A sensor is disposed at a distance away from the toner transfer mechanism along the print medium path. This distance is approximately equal to an integer multiple of the resulting distance traveled by the medium during one revolution of the lowest frequency component of the transport system. The frequencies associated with all other components in the transport system, including the actuator and encoder wheel, are designed to be an integer multiple of this lowest frequency. The sensor senses a position of the sheet of print medium.

An advantage of the present invention is that error in the calculation of paper position is minimized.

Another advantage is that the leading edge of the paper can be more accurately aligned with an image on an intermediate transfer member.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
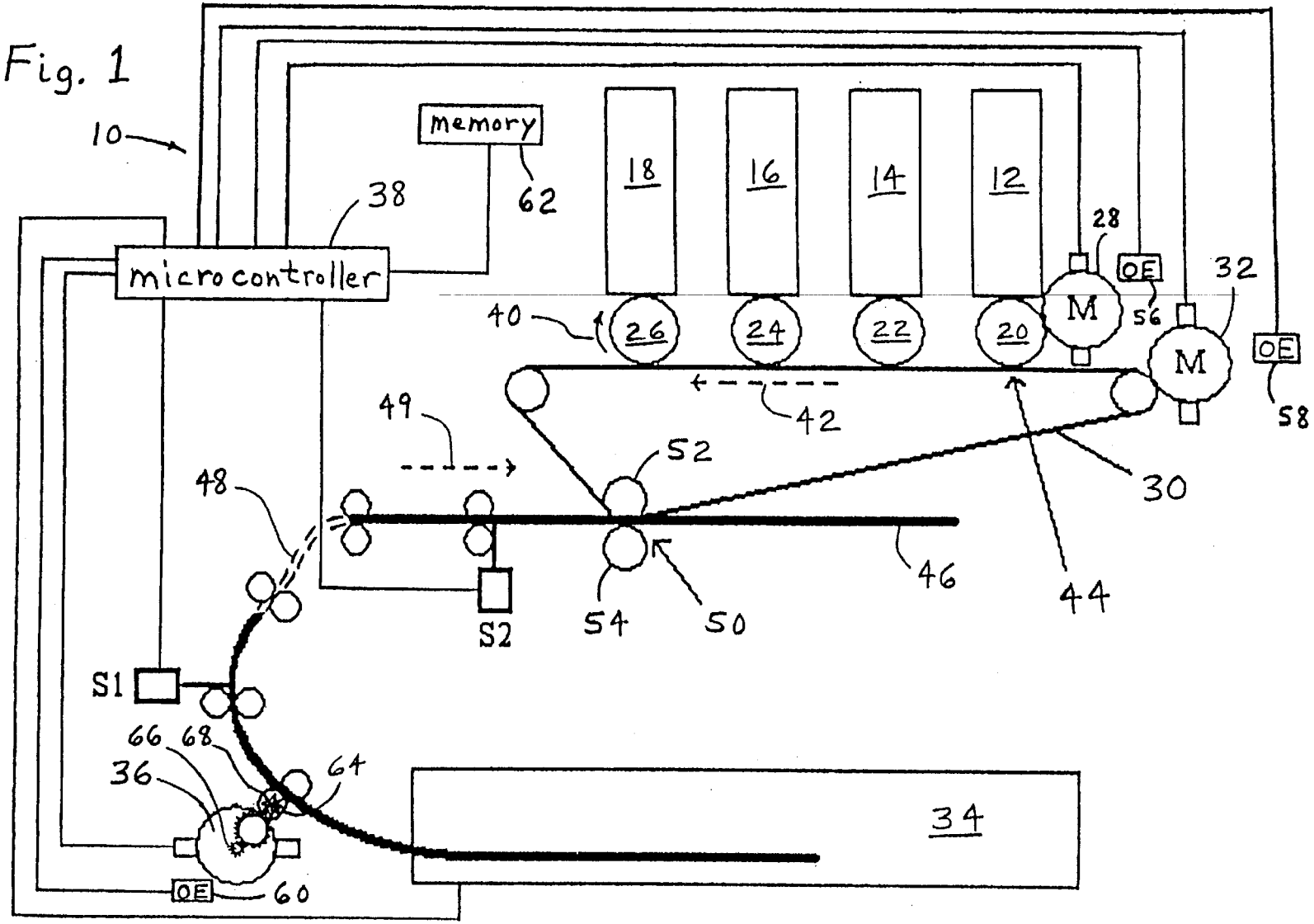
FIG. 1 is a partial, schematic, side view of one embodiment of a laser printer in which the method of the present invention may be used.

Referring now to the drawings, and, more particularly, to FIG. 1, there is shown one embodiment of a multicolor laser printer 10 including toner cartridges 12, 14, 16, 18, photoconductive drums 20, 22, 24, 26, a drum motor 28, an intermediate transfer member belt 30, a belt motor 32, an input paper tray 34, a paper path motor 36, paper path sensors S1, S2, and a microcontroller 38 connected to a memory device 62.

Each of four laser print heads (not shown) scans a respective laser beam in a scan direction, perpendicular to the plane of FIG. 1, across a respective one of photoconductive drums 20, 22, 24 and 26. Each of photoconductive drums 20, 22, 24 and 26 is negatively charged to approximately −900 volts and is subsequently discharged to a level of approximately −200 volts in the areas of its peripheral surface that are impinged by a respective one of the laser beams. During each scan of a laser beam across a photoconductive drum, each of photoconductive drums 20, 22, 24 and 26 is continuously rotated, clockwise in the embodiment shown, in a process or "cross-scan" direction indicated by direction arrow 40. The scanning of the laser beams across the peripheral surfaces of the photoconductive drums is cyclically repeated, thereby discharging the areas of the peripheral surfaces on which the laser beams impinge.

The toner in each of toner cartridges 12, 14, 16 and 18 is of a separate, respective color, such as cyan, magenta, yellow and black. Thus, each of the four laser print heads controls printing in a respective color, such as cyan, magenta, yellow or black. Further, the toner in each of toner cartridges 12, 14, 16 and 18 is negatively charged to approximately −600 volts. Thus, when the toner from cartridges 12, 14, 16 and 18 is brought into contact with a respective one of photoconductive drums 20, 22, 24 and 26, the toner is attracted to and adheres to the portions of the peripheral surfaces of the drums that have been discharged to −200 volts by the laser beams. As belt 30 rotates in the direction indicated by arrow 42, the toner from each of drums 20, 22, 24 and 26 is transferred to the outside surface of belt 30 in a respective drum transfer nip 44. As a print medium, such as paper 46, travels along a paper path 48 in the direction indicated by arrow 49, the toner is transferred from belt 30 to the surface of the paper 46 in a paper transfer nip 50 between opposing rollers 52 and 54. Paper transfer nip 50 is also referred to herein as a "toner transfer nip".

Imaging begins, at least on first photoconductive drum 20, before a first sheet of paper 46 is picked from input tray 34. The image begins to be transferred onto transfer belt 30, and when the image on belt 30 reaches a point that is a certain distance away from nip 50, tray 34 receives a pick command from microcontroller 38.

By monitoring the printhead scan data, microcontroller 38 determines when the electrophotographic system begins to image on photoconductive drum 20. Microcontroller 38 then determines at what point in time the first line of the image is placed onto transfer belt 30 by monitoring, in addition to the scan data, the number of revolutions and rotational position of drum motor 28. Drum motor 28 drives photoconductive drum 20. Drum motor 28 may or may not also drive drums 22, 24 and 26. The number of revolutions and rotational position of drum motor 28 is ascertained by an encoder 56, as is well known in the art.

As the first writing line is transferred onto transfer belt 30, microcontroller 38 begins to track incrementally the position of the image on belt 30 by monitoring the number of revolutions and rotational position of belt motor 32. Similarly to drum motor 28, the number of revolutions and rotational position of belt motor 32 can be ascertained by another encoder 58. From the number of rotations and rotational position of belt motor 32, the linear movement of belt 30 and the image carried thereby can be directly calculated. Since both the location of the image on transfer belt 30 and the length of belt 30 between the first drum transfer nip 44 and paper transfer nip 50 is known, the distance remaining for the image to travel before reaching paper transfer nip 50 can also be calculated.

At some designated time, input tray 34 receives a command from microcontroller 38 to pick a sheet of paper. The sheet of paper moves through paper path 48 at a substantially constant speed and eventually trips a paper path sensor S1. Microcontroller 38 immediately begins tracking incrementally the position of the paper by monitoring the feedback of yet another encoder 60, this one being associated with paper path motor 36. From the tracked distance traveled by the sheet of paper after tripping paper path sensor S1, and the known distance between S1 and paper transfer nip 50, the distance remaining for the sheet of paper to travel before reaching paper transfer nip 50 can be calculated.

Optical sensors, such as S1 and S2, are placed throughout paper path 48 in order to provide actual media position information at discrete locations, and the position is tracked incrementally by monitoring optical encoder 60 attached to drive motor 36. However, due to anomalies such as irregular trip points of the sensors, manufacturing run-out in gears, and the eccentricity in the motor encoder 60, the actual position of paper 46 can vary substantially from its estimated position. This is a problem when an accurate paper position is needed in order to align the leading edge of the print medium with an image on belt 30.

An accurate estimate of paper position is obtained through use of the position control loop described above with reference to FIG. 1. The success of the paper alignment with the image hinges on the accuracy of the paper position calculation. Since the calculation is determined from the sensors and encoder signals, those elements of the system must provide data that is as accurate as possible.

Inconsistencies in the position data can be caused by the following primary sources of error: 1) drive train transmission errors developed between the mesh of the drive system motor pinion 66 and first gear 68; and 2) eccentricity in the motor encoder 60 causing velocity variation of paper 46.

The present invention provides a system whereby the error in the paper position calculation is minimized by strategically designing the transmission system, placement of the paper position sensing devices and placement of the encoder wheel. The error correction routine that aligns paper 46 with the image gets its absolute initial paper position from optical sensor S1. When sensor S1 is tripped, the routine calculates the remaining distance that paper 46 must travel before reaching transfer nip 50. Once sensor S1 determines the absolute initial paper position, one would expect the number of motor encoders needed to move paper 46 from sensor S1 to transfer nip 50 to be constant (i.e., for a constant distance between sensor S1 and nip 50). However, if sensor S1 is placed arbitrarily, the position calculation could contain substantial error.

Figure 2:
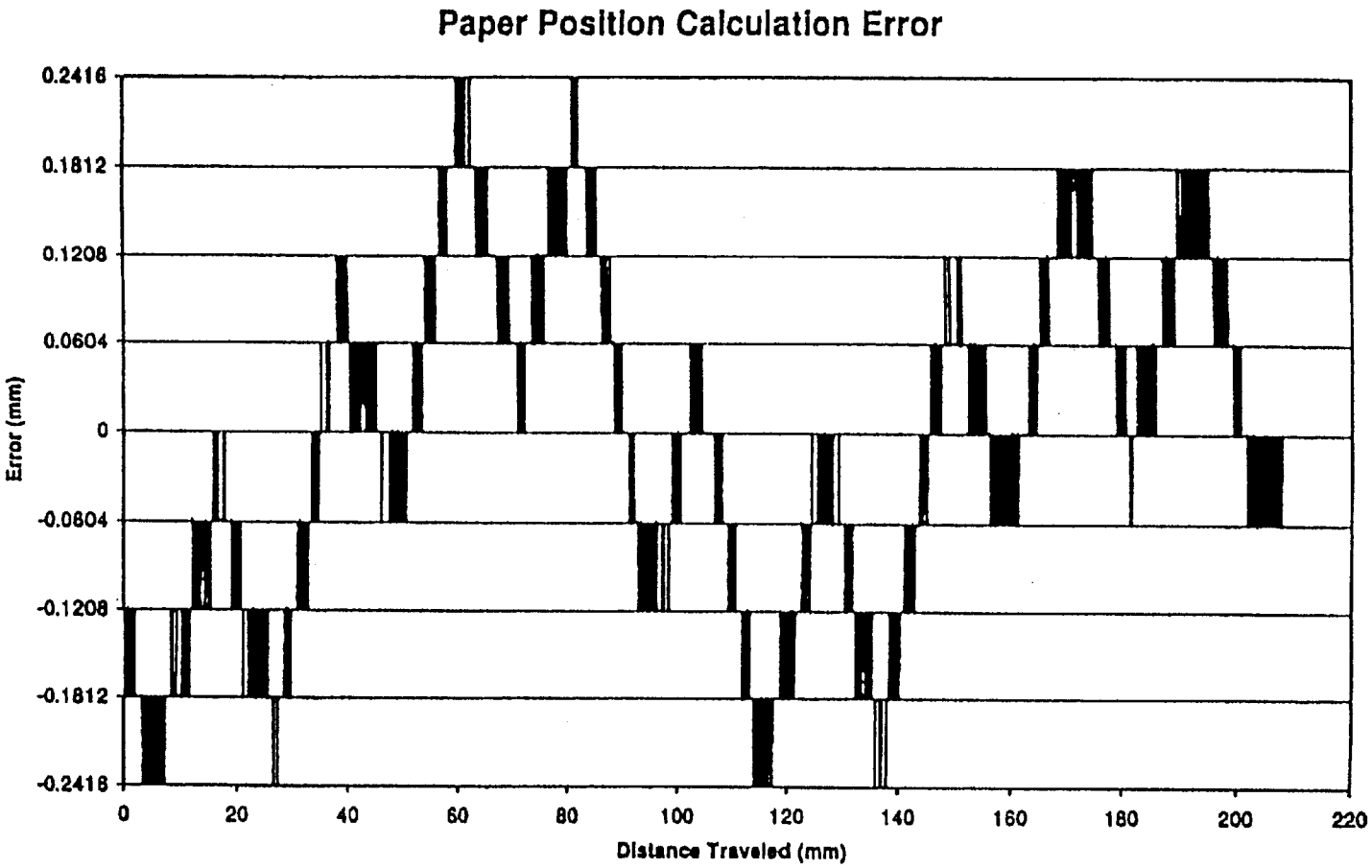
FIG. 2 is a plot of paper position calculation error versus distance traveled by the paper.

To better understand the error in the position calculation, a comparison can be made between the calculated position of paper 46 versus the actual position of paper 46 as it moves through paper path 48. Optical encoder 60 from paper path drive motor 36 can be used to determine the theoretical incremental position of paper 46. The calculated position is compared against the actual position that is determined by attaching a high resolution optical encoder strip to a sheet of paper and having it pass through a sensor capable of reading such an encoder strip. Comparing the two encoder signals yields the actual error in the position calculation. FIG. 2 shows the error in the calculation as the sheet moves through paper path 48.

Analysis of FIG. 2 reveals that the error signal has two fundamental frequencies of interest. The first is a frequency associated with the motor encoder 60 and motor pinion 66. This component of the error may be due to the low quality and low cost manufacturing process of motor pinion 66, and eccentricity errors introduced in the assembly of encoder 60 onto the motor shaft 36. The second is the gear mesh frequency of the motor pinion 66 to first speed reduction gear 68. This component of the error may be due to eccentricity and/or run-out errors introduced into the manufacture of reduction gear 68. The first mesh introduces an error that is periodic with each revolution of the motor shaft, thus creating transmission error in the drive train that results in the paper moving varying distances for a given angular displacement of motor 36.

For example, depending upon the starting position of the shaft of motor 36, paper 46 may move farther for the first half revolution than the second half revolution of roll 64.

Figure 3:
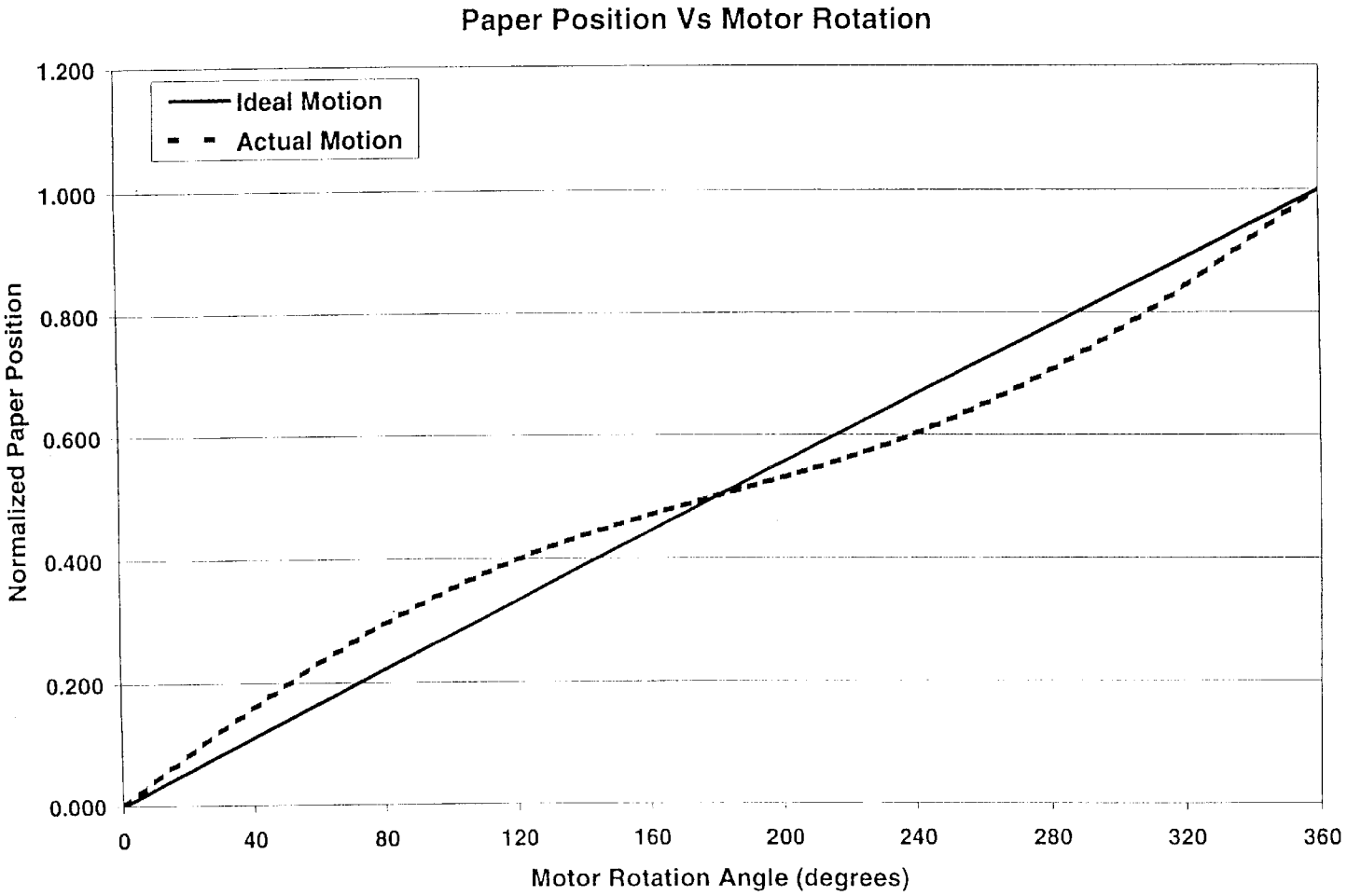
FIG. 3 is a plot of normalized paper position versus motor rotation.
Figure 4:
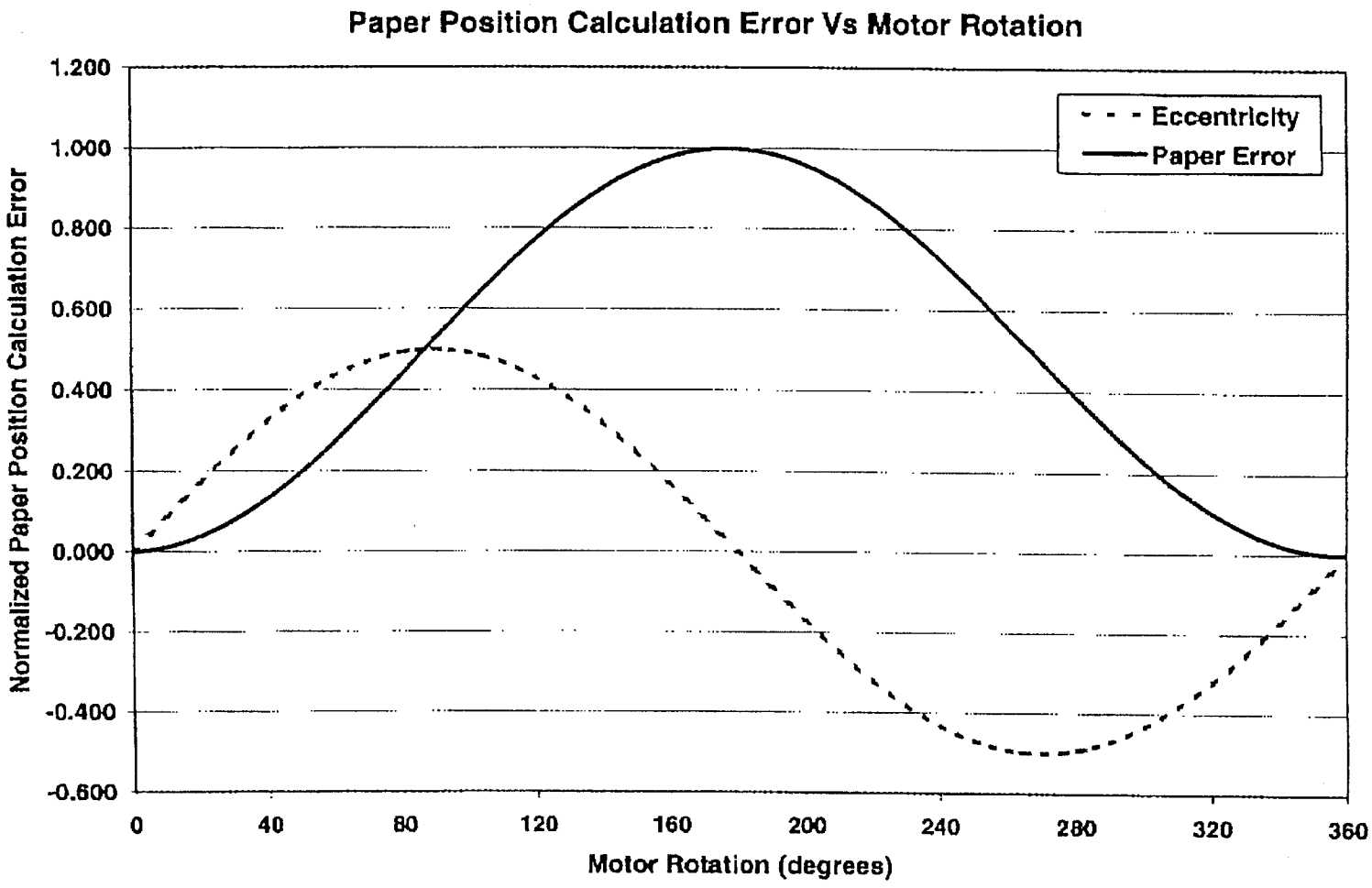
FIG. 4 is a plot of normalized paper position calculation error versus motor rotation.

FIGS. 3 and 4 illustrate this condition. In FIG. 3, an ideal motion of media through a paper path is compared with the actual motion. As can be seen in FIG. 3, the actual paper position may be ahead of or behind of the ideal paper position. FIG. 4 shows the cumulative error introduced by the eccentricity of any one contributing component. Since there are multiple contributing components in the paper path, the magnitude of the total error will vary depending upon the relative phase of each individual component to the others.

These figures illustrate that, depending upon where the error correction control algorithm begins (i.e., where the optical sensor is placed relative to transfer nip 50), there could be a sizeable amount of error in the position calculation. This amount of unknown error could represent a significant amount of the allowable error budget that the control algorithm must operate within. The optimal placement of the sensor from the nip is at a distance equal to an integer multiple of the resulting distance traveled by the medium during one revolution of the lowest frequency component of the transport system. If this is the case, FIG. 4 shows that the error introduced by the eccentricity will not be present in the position calculation. If, however, the sensor is placed at one-half this distance, significant error can be introduced. In other words, regardless of the severity of the eccentricity, the gear must always turn an integer number of revolutions to move the paper from the sensor to transfer nip 50. This means the number of motor encoders that should be counted will always be the same over this distance—something that will not be true if the sensor is placed at any other arbitrary distance from nip 50.

This approach addresses the error introduced from the lowest frequency component, but the error due to the encoder eccentricity and/or motor pinion could still be present. To cancel this error, the smallest period of any component is made to be an even harmonic multiple of the period of the shaft of motor 36. This ensures that the same integer number of revolutions of the shaft motor 36 always occurs during each revolution of the lowest frequency component. This allows the error of encoder 60 and pinion 66 to overlay with the error from the lowest frequency component, but at a higher frequency. Therefore, the errors due to all components in the calculation are simultaneously minimized.

Figure 5:
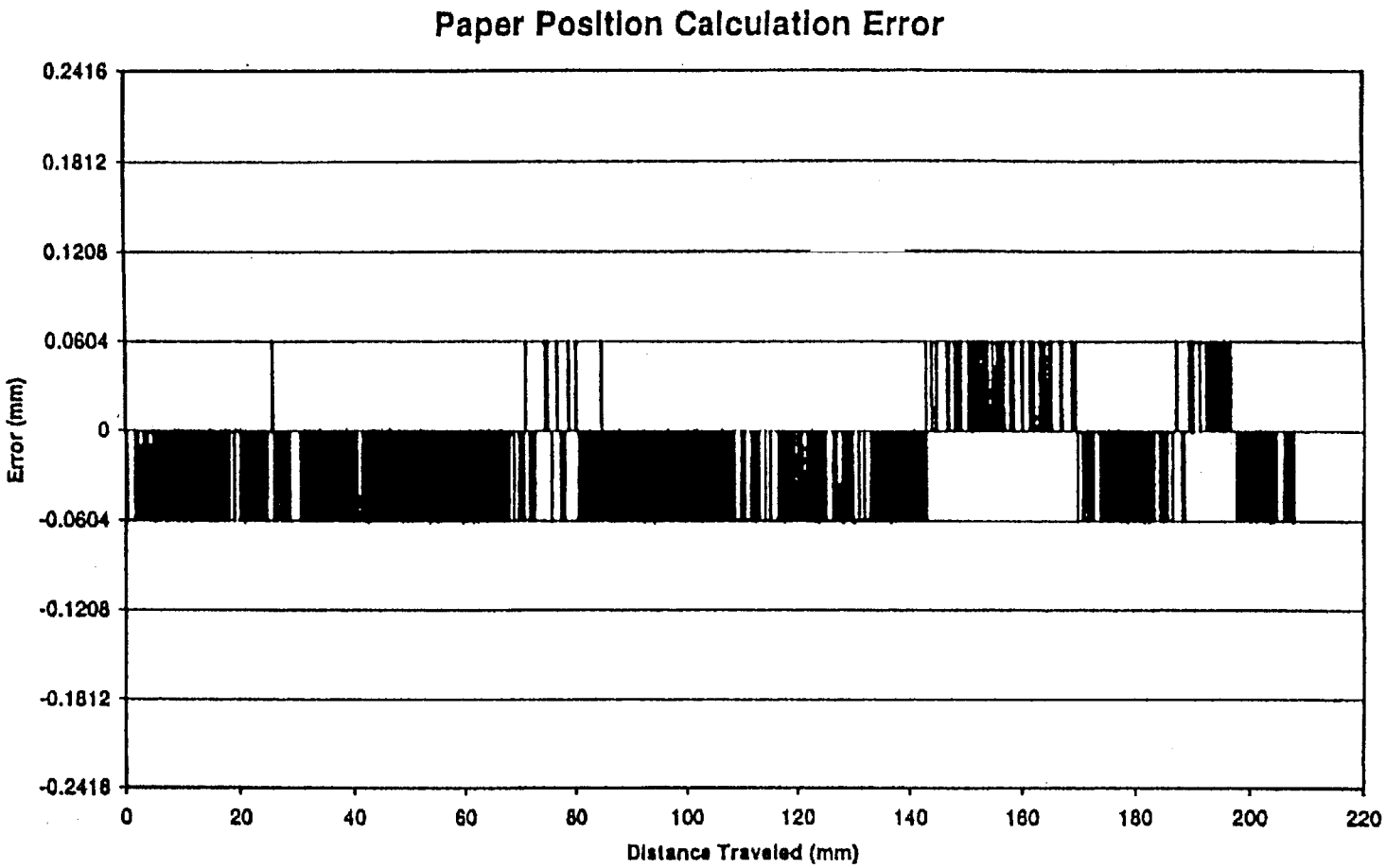
FIG. 5 is a plot, resulting from one embodiment of the method of the present invention, of paper position calculation error versus distance traveled by the paper.

Using the same apparatus used in the previous example that generated the error depicted in FIG. 2, the error present in the calculation using the method of the present invention is shown in FIG. 5. If the paper position is sensed at a distance from the nip 50 that is an integer multiple of the distance traveled in one revolution of the lowest frequency component, the resultant error is within the resolution of optical encoder 60 of paper path motor 36 (approximately 0.06 mm per encoder pulse).

The present invention provides an optimum design of the transport system that includes the gearing system, placement of sensors in a paper path, and placement of an encoder to minimize errors in paper position calculation. In summary, all components are designed to have frequencies that are an even harmonic multiple of the lowest frequency of the transport system. The drive motor encoder and pinion are made to rotate an integer number of times for each rotation of the lowest frequency component. The sensor requiring the most accuracy is placed at a distance away from the transfer nip that is equivalent to an integer multiple of the distance traveled in one revolution of this lowest frequency component. All other sensors are also placed in this same manner. If this is not possible, the sensors are placed at integer distances relating to other frequencies so as to remove the error due to as many components as possible. Placing sensors at distances from the transfer nip that are mid-way between consecutive integer multiples of any frequency is avoided.

The present invention minimizes the error introduced into the paper position calculation and leads to a more accurate registration of the paper relative to the image, when the two are married at the transfer nip.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of minimizing error in an estimate of a position of a sheet of print medium in an electrophotographic machine, said method comprising the steps of:

providing a transport system for moving the sheet of print medium along a print medium path;

actuating said transport system with a rotating actuator such that said actuator rotates approximately an integer number of times during a corresponding rotation of a lowest frequency component of said transport system;

detecting motion of said rotating actuator; and sensing the position of the sheet of print medium with a sensor.

2. A method of minimizing error in an estimate of a position of a sheet of print medium in an electrophotographic machine, said method comprising the steps of:

providing a transport system for moving the sheet of print medium along a print medium path;

providing the electrophotographic machine with a toner transfer point at which the toner can be transferred to the moving sheet of print medium;

actuating said transport system with a rotating actuator;

detecting motion of said actuator;

placing a sensor at a location along the print medium path such that the print medium path has a length between the location and the toner transfer point approximately equal to an integer multiple of a resulting distance traveled by the medium during an integer number of revolutions of said actuator; and sensing the position of the sheet of print medium with said sensor.

3. A method of minimizing error in an estimate of a position of a sheet of print medium in an electrophotographic machine, said method comprising the steps of:

providing a transport system to actuate a drive roll for moving the sheet of print medium along a print medium path;

providing the electrophotographic machine with a toner transfer point at which the toner can be transferred to the moving sheet of print medium;

placing a sensor at a location along the print medium path such that the print medium path has a length between the location and the toner transfer point approximately equal to an integer multiple of a resulting distance traveled by the medium during one revolution of a lowest frequency component of the transport system; and sensing the position of the sheet of print medium with said sensor.

4. A method of minimizing error in an estimate of a position of a sheet of print medium in an electrophotographic machine, said method comprising the steps of:

providing a transport system to actuate a drive roll for moving the sheet of print medium along a print medium path;

providing the electrophotographic machine with a toner transfer point at which the toner can be transferred to the moving sheet of print medium;

actuating said transport system with a rotating actuator such that said actuator rotates approximately a first integer number of times during a corresponding rotation of a lowest frequency component of said transport system;

placing a sensor at a location along the print medium path such that the print medium path has a length between the location and the toner transfer point approximately equal to a resulting distance traveled by the medium in one rotation of said lowest frequency component during an second integer number of revolutions of said actuator;

detecting motion of said actuator with a detecting means such that said actuator rotates approximately a third integer number of revolutions during a corresponding rotation of said detecting means; and sensing the position of the sheet of print medium with said sensor.

5. The method of claim 4, wherein said second integer is a multiple of said first integer.

6. The method of claim 4, wherein said second integer is a multiple of said third integer.

7. A method of minimizing error in an estimate of a position of a sheet of print medium in an electrophotographic machine, said method comprising the steps of:

providing a transport system to actuate a drive roll for moving the sheet of print medium along a print medium path;

providing the electrophotographic machine with a toner transfer point at which the toner can be transferred to the moving sheet of print medium;

placing a sensor at a location along the print medium path such that the print medium path has a length between the location and the toner transfer point approximately equal to an integer multiple of a resulting distance traveled by the medium during one revolution of a lowest frequency component of the transport system;

actuating said transport system with a rotating actuator such that said actuator rotates approximately an integer number of times during a corresponding rotation of said lowest frequency transport system component;

detecting motion of said actuator with a detecting means such that said actuator rotates approximately an integer number of revolutions during a corresponding rotation of said detecting means; and sensing the position of the sheet of print medium with said sensor.

8. The method of claim 7, wherein said toner transfer point comprises a toner transfer nip.

9. The method of claim 7, wherein said sensor comprises an optical sensor.

10. The method of claim 7, wherein said rotating actuator comprises a pinion.

11. The method of claim 10, wherein a component of error due to said pinion is canceled out over a course of an integer number of revolutions of said pinion.

12. The method of claim 7, wherein said detecting means comprises an encoder.

13. The method of claim 12, wherein a component of error due to said encoder is cancelled out over a course of an integer number of revolutions of said encoder.

14. The method of claim 7, wherein said transport system includes a gearing system having a plurality of gears, all said gears of said gearing system being configured to rotate approximately an integer number of revolutions for every corresponding revolution of said lowest frequency component.

15. The method of claim 14 wherein a component of error due to the rotation of each of said gears is cancelled out over a course of an integer number of rotations of each of said gears.

16. An electrophotographic machine, comprising:

a transport system to actuate a drive roll for moving a sheet of print medium along a print medium path;

a toner transfer mechanism configured to transfer toner to the moving sheet of print medium;

a sensor disposed at a location along the print medium path such that the print medium path has a length between the location and the toner transfer mechanism approximately equal to an integer multiple of a resulting distance traveled by the medium during one revolution of a lowest frequency component of the transport system, said sensor being configured to sense a position of the sheet of print medium;

a rotating actuator configured to actuate said transport system such that said actuator rotates approximately an integer number of times during a corresponding rotation of said lowest frequency component; and means for detecting motion of said actuator such that said actuator rotates approximately an integer number of revolutions during a corresponding rotation of said detecting means.

17. The machine of claim 16, wherein said transport system includes a gearing system having a plurality of gears, all said gears of said gearing system being configured to rotate approximately an integer number of revolutions for every corresponding revolution of said lowest frequency component.

18. The machine of claim 16, wherein said toner transfer mechanism comprises a toner transfer nip.

19. The machine of claim 16, wherein said sensor comprises an optical sensor.

20. The machine of claim 16, wherein said rotating actuator comprises a pinion.

21. The machine of claim 16, wherein said detecting means comprises an encoder.

* * * * *